US007998230B2

(12) United States Patent
Bonneau et al.

(10) Patent No.: US 7,998,230 B2
(45) Date of Patent: Aug. 16, 2011

(54) POLYMETAL POWDER AND SINTERED COMPONENT PRODUCED BASED ON THIS POWDER

(75) Inventors: Maxime Bonneau, Le Fontanil (FR); Jean-François Lartigue, La Tronche (FR); Thierry Commeau, Grenoble (FR); Christian Huet, St Simeon-de-Bressieux (FR)

(73) Assignee: Eurotungstene Poudres, Grenoble (FR)

( * ) Notice: Subject to any disclaimer, the term of this patent is extended or adjusted under 35 U.S.C. 154(b) by 255 days.

(21) Appl. No.: 12/093,060

(22) PCT Filed: Nov. 3, 2006

(86) PCT No.: PCT/FR2006/002458

§ 371 (c)(1),
(2), (4) Date: Jul. 23, 2008

(87) PCT Pub. No.: WO2007/057533

PCT Pub. Date: May 24, 2007

(65) Prior Publication Data

US 2009/0188171 A1 Jul. 30, 2009

(30) Foreign Application Priority Data

Nov. 9, 2005 (FR) ..... 05 11420

(51) Int. Cl.
*C09K 3/14* (2006.01)
*C22C 30/02* (2006.01)

(52) U.S. Cl. ..... 51/309; 51/307; 420/8; 420/123; 420/496; 420/582; 75/228; 75/230; 75/232; 75/236; 75/243; 75/245; 75/246; 75/255; 75/252

(58) Field of Classification Search ..... 51/307, 51/309; 420/8, 123, 496, 582; 75/228, 230, 75/232, 236, 243, 245, 246, 255, 252
See application file for complete search history.

(56) References Cited

U.S. PATENT DOCUMENTS

| | | | | |
|---|---|---|---|---|
| 6,312,497 | B1 * | 11/2001 | Standaert | 419/11 |
| 6,554,885 | B1 * | 4/2003 | Mende et al. | 75/365 |
| 6,576,037 | B1 * | 6/2003 | Bonneau et al. | 75/246 |
| 6,613,122 | B1 * | 9/2003 | Bonneau et al. | 75/255 |
| 2005/0106057 | A1 * | 5/2005 | Kamphuis et al. | 419/11 |

FOREIGN PATENT DOCUMENTS

| | | | |
|---|---|---|---|
| WO | 0023630 | A1 | 4/2000 |
| WO | 0023631 | A1 | 4/2000 |
| WO | 03083150 | A1 | 10/2003 |

OTHER PUBLICATIONS

Consolidation of Diamond Tools Using Cu-Co-Fe based Alloys as Metallic Binders, M. del Villar et al, Powder Metallurgy, Maney Publishing, London, GB, vol. 44, No. 1, 2001, pp. 82-90.

* cited by examiner

*Primary Examiner* — Elizabeth D Wood
(74) *Attorney, Agent, or Firm* — Sughrue Mion, PLLC

(57) ABSTRACT

A multi-metal powder, in particular for producing diamond tools comprises iron copper, cobalt and molybdenum whose contents are expressed in the following mass percentages: Fe+Cu+Co+Mo=98 mass %, the rest being oxygen and production impurities, wherein 15%=Cu=35%, 0.03=Mo/(Co+Fe+Mo)=0.10, —Fe/Co=2. A sintered compact is obtained by hot compaction of said multi-metal powder, for example, in the form of a diamond cutting tool.

8 Claims, No Drawings

POLYMETAL POWDER AND SINTERED COMPONENT PRODUCED BASED ON THIS POWDER

The invention relates to the field of metal powders referred to as "prealloyed powders" or "polymetal powders" which are used in powder metallurgy, in particular for the production of diamond-containing tools.

In order to produce diamond-containing tools which are intended in particular for cutting stone, construction materials or asphalt, the most common method involves mixing diamonds with a metal binding agent in the form of a mixture of powders, pressing the diamond-containing mixture in a cold press, transferring the component which has been pressed in this manner in a graphite pressing tool, and finally consolidating the compact in a hot press by means of sintering. The parameters to be considered during the production of these tools are as follows.

a) Composition of the Binding Agents

In accordance with the nature of the material to be cut, in particular the hardness and the abrasive nature thereof, the composition of the binding agent is selected in order to adjust the hardness, the impact resistance and the wear resistance of the tool. The object is to optimise either the cutting speed or the service life of the tool, whilst minimising the power required for cutting.

The materials which are most commonly used are micronic powders of cobalt, iron, nickel, copper and atomised powders (typically from 5 to 100 μm) of bronze, copper and tin. These base binding agents can be supplemented with micronic WC tungsten carbide, molten carbide (typically from 50 to 500 μm) or micronic tungsten in order to increase the wear resistance.

b) Cold Pressing at from 150 to 500 MPa

The pressure is adjusted in order to obtain a compact whose green properties are sufficient to allow it to be handled. In order to facilitate the automatic supply of the presses, the binding agent+diamond mixture is most often granulated using an organic additive. The size of the granules is typically from 50 to 700 μm.

c) Hot Pressing

The object of this step is to crimp the diamond in a binder matrix whose relative density is greater than 95% of the theoretical density thereof. To this end, pressures in the order of from 25 to 50 MPa, and temperatures in the order of from 700 to 1100° C. are used. The sintering plateau at maximum temperature lasts from 2 to 10 minutes. The temperature is selected in accordance with the nature of the binding agent, in order to optimise its properties of hardness, impact resistance, wear resistance and retention of the diamond. It must be minimised in order not to degrade the diamonds by means of graphitisation. The use of diamonds which are coated with titanium, chromium, silicon or nickel allows the resistance of the diamonds against graphitisation to be improved and the chemical bond between the diamond and metallic binding agent to be improved.

The components obtained in this manner are mounted on a steel support having different shapes in order to produce tools, such as circular saws, core drills, polishing heads, diamond-containing threads, etc. The fixing is carried out by means of soldering or laser welding.

Historically, the base for binding agents used for cutting the strongest materials, such as granite, sandstones, concretes, asphalts, is pure cobalt in the form of very fine powders (from 0.8 to 5 μm). Cobalt produces an excellent compromise between the hardness (95 to 110 HRB on the Rockwell B scale in accordance with the standard ISO 6508-1), the impact resistance (from 20 to 50 J/cm$^2$ of energy at break in a CHARPY test in accordance with the standard ISO 5754), resistance to corrosion, resistance to oxidation in the powder state (initial contents in terms of oxygen less than 1% and development in an atmosphere at 35° C. and 80% relative humidity not exceeding 0.6% in 48 hours). The main disadvantage of cobalt is the relative natural scarcity thereof together with a high price which is further subject to rapid and very wide fluctuations.

In recent years, the use of polymetal powders which are produced by means of co-precipitation of metal salts followed by hydrogen reduction, has been developed with pure cobalt being replaced in the production of diamond-containing tools which are intended principally to cut natural stone. In particular, the first generation of Cu—Fe—Co products developed by the Applicant, in addition to the price advantages thereof (lower and more stable than that of pure cobalt), has allowed the efficiency levels of cutting tools to be improved. In particular, the ease of cutting has been increased: higher cutting speeds have become possible without increasing the power consumed, and with the service life of the tool being maintained at a high level.

Documents WO-A-00/23630, WO-A-00/23631, WO-A-98/49361, WO-A-03/083150 are representative of what may constitute polymetal powders which can be used in this context.

However, for some applications in the field of construction, such as high-power sawing, sawing of unset concrete, cutting asphalt, the mechanical properties of the tools which are produced from these known powders have been found to be insufficient. In these applications, the levels of impact resistance and hardness required are greater than that which could be obtained, for example, from Cu—Fe—Co powders. Consequently, this market segment continues to use pure cobalt as a base for its binding agents. The first generation Cu—Fe—Co powders do not exceed a hardness of 107 HRB coupled with a CHARPY energy at break of 15 J/cm$^2$, whilst the characteristics desired for this market are a hardness greater than 108 HRB and a CHARPY energy at break greater than 20 J/cm$^2$.

The object of the invention is to provide a polymetal powder which is capable in particular of producing diamond-containing tools which comply with these strict requirements, whilst being less costly than the cobalt-based powders which are conventionally used.

To this end, the invention relates to a polymetal powder, in particular for the production of diamond-containing tools, characterised in that it contains iron, copper, cobalt and molybdenum in contents, in percentages by mass, such that:

$Fe+Cu+Co+Mo \geqq 98\%$, the balance being oxygen and impurities resulting from the production operation;

$15\% \leqq Cu \leqq 35\%$ $0.03 \leqq Mo/(Co+Fe+Mo) \leqq 0.10$ $Fe/Co \geqq 2$.

Preferably, $Co+Mo \leqq 30\%$.

Preferably:

$Fe+Cu+Co+Mo \geqq 98\%$, the balance being oxygen and impurities resulting from the production operation $40.5\% \leqq Fe \leqq 46.5\%$ $29\% \leqq Cu \leqq 35\%$ $17\% \leqq Co \leqq 21\%$ $5\% \leqq Mo \leqq 6\%$.

This polymetal powder may have been supplemented with at least one abrasive additive.

The abrasive additive can be selected from oxides and carbides.

This polymetal powder may have been supplemented with at least one softening additive.

The softening additive can be selected from copper and bronze.

The invention also relates to a component which is sintered by means of hot-pressing a polymetal powder, characterised in that the polymetal powder is a polymetal powder of the above type.

The polymetal powder may have been mixed with a diamond powder.

The sintered component may be a diamond-containing cutting tool.

As will be appreciated, the invention relates to a polymetal powder which uses copper, iron, cobalt and molybdenum. Compared with conventional Cu—Fe—Co powders, the addition of molybdenum and the precise balance of the composition as proposed allow diamond-containing tools to be produced whose levels of cutting performance, under the most demanding conditions, are found to be the same as and even sometimes superior to those of the cobalt-based tools which are conventionally used. On the other hand, these powders have a cost price which remains lower than that of the powders of pure cobalt.

The invention will be better understood from a reading of the following description.

It was known that polymetal Cu—Fe—Co powders are necessarily biphase. A first phase is very rich in terms of Cu, a second phase is very rich in terms of Fe and Co and these two phases have only a very low level of mutual solubility.

It was further known that elements such as W and Mo tend to harden the Fe—Co phase. However, given that the corresponding quaternary phase diagrams are not very well known, it was not possible without extensive research to estimate in a quantitative and precise manner the influences that such elements could have on the properties of the Cu—Fe—Co powders.

Owing to research of this type, the inventors have been able to demonstrate a narrow composition range for a Cu—Fe—Co—Mo powder which allows the desired excellent compromise to be achieved between the various properties, whilst retaining for the powder, compared with Co based powders, a cost price which is attractive and not too dependent on the fluctuations of raw material prices. These powders thus offer remarkable levels of flexibility and impact resistance together with a level of hardness which is compatible with the most demanding applications for diamond-containing tools.

The composition range of the powders according to the invention is defined by the following criteria. The contents are given in percentages by mass.

The total of the contents in terms of Cu, Co, Fe and Mo is at least 98%, the balance being oxygen and impurities resulting from the production operation.

No element other than Cu, Co, Fe and Mo must be present at a content of more than 0.5%. This is particularly the case for Sn which, at a higher content, would have an embrittling effect by generating hard and brittle phases during cooling.

The content in terms of Cu, which determines the relative significance of the phase which is rich in terms of Cu compared with the phase which is rich in terms of Fe—Co—Mo is between 15 and 35% in order to ensure the densification of the sintering, without excessively reducing the hardness.

The relationship Mo/(Co+Fe+Mo) must be between 0.03 and 0.10 in order to obtain an effective level of hardening without risking undesirable embrittling.

The relationship Fe/Co must be greater than or equal to 2 so that the composition of the Fe—Co—Mo phase allows the desired hardness/impact strength compromise to be obtained.

Preferably, for economic reasons, the total Co+Mo does not exceed 30% of the total composition.

A preferred composition range of the polymetal powder according to the invention is:

$Fe+Cu+Co+Mo \geqq 98\%$ $40.5 \leqq Fe \leqq 46.5\%$ $29\% \leqq Cu \leqq 35\%$ $17\% \leqq Co \leqq 21\%$ $5\% \leqq Mo \leqq 6\%$ An example of a method for preparing the polymetal powder according to the invention conventionally involves first producing a mixture of aqueous solutions of metal chlorides of Cu, Fe and Co, these metal elements being found in the mixture in accordance with relative proportions corresponding to those intended for the final powder.

The metals are then precipitated by means of adding caustic wash with a high level of agitation. A polymetal hydroxide precipitate is obtained which is filtered and washed until a content of Na lower than 0.04% is obtained relative to the total Co+Cu+Fe. It is dried and reduced to coarse powder of less than 100 μm.

This powder is then impregnated with an aqueous solution of ammonium molybdate prepared from a soluble molybdenum salt, the proportion of Mo relative to the other metals corresponding to that which is intended for the final powder.

The impregnated powder is hydrogen-reduced in a through type oven at a temperature of from 750-850° C. for from 2 to 10 hours. This allows the metal to be obtained in the form of agglomerated micronic powder.

A grinding step allows the polymetal powder to be obtained in a state ready to be sintered, typically with a Fisher granulometry of 3 μm (defined by the standard ISO10070) and an oxygen content of less than 0.8%.

The documents of the prior art cited above describe methods for preparing polymetal powders which are similar to the method which has been described above, and to which reference may be made for further details.

The polymetal powder according to the invention has a resistance to oxidation which is remarkably high compared with powders based on pure Co and conventional Cu—Fe—Co powders. A powder according to the invention initially containing 0.3% of oxygen captures only 0.1% of additional oxygen in an atmosphere of 80% relative humidity at 35° C. for 48 hours. Under the same conditions, the recovery of oxygen of a powder based on pure Co would be 0.5% and that of a Cu—Fe—Co powder having 50% of Cu, 25% of Fe and 25% of Co would be in the order of 2%. This provides an excellent level of stability for the properties of the components and tools which will subsequently be produced by means of sintering the powders according to the invention. On the other hand, the oxides present during hot pressing, even if they are partially reduced during the sintering operation, cause structural defects which are embrittling. The low level of sensitivity to oxidation of the powder according to the invention ensures that there will not be a significant level of defects of this type, even if the storage conditions of the powder prior to hot pressing were not optimal. Finally, this low level of sensitivity to oxidation is a safety criterion: it ensures that, in spite of the relatively high presence of Fe, the powder will not become dangerously heated in contact with damp air.

The pressure and temperature range during sintering of the powders according to the invention in a hot press allowing components to be obtained whose density is greater than or equal to 95% of the theoretical density has been determined.

For a temperature of 900° C., the minimum pressure is 45 MPa, for a duration of 3 minutes.

For a temperature of 950° C., the minimum pressure is 37.5 MPa, for a duration of 3 minutes.

For a temperature of 975° C., and above, the minimum pressure is 35 MPa, for a duration of 3 minutes.

A temperature of 975° C., a pressure of 35 MPa and a duration of 3 minutes are recommended. The high temperature promotes the development of the hardness provided by the Mo.

Table 1 sets out the properties of Rockwell B hardness, impact resistance and force at break of samples which do not contain diamond and which have been sintered by means of hot pressing, under specific conditions, of a powder according to the invention having a composition Fe=43.5%, Cu=32.0%, Co=19.0%, Mo=5.5%. They are compared with those of series of reference samples having the compositions:

- reference 1: Fe=58.0%, Cu=16.0%, Co=26.0%; it differs from the invention substantially in that it does not comprise MO;
- reference 2: Fe=25.0%, Cu=50.0%, Co=25.0%; it corresponds to Cu—Fe—Co products of the prior art;
- reference 3: Co=100% with grains of a mean size of 1.8 μm;
- reference 4: Co=100% with grains of a very fine size of 0.9 μm.

The force at break was measured using 3 point flexion tests. It is considered to be an indicator of correct retention of the diamonds if the powder tested were to be used for the production of diamond-containing tools.

TABLE 1

Sintering conditions and mechanical properties of the tested samples

| | Hot press sintering | Rockwell B hardness | Impact resistance | Force at break |
|---|---|---|---|---|
| invention | 975° C./ 35 MPa | 108-110 HRB | 25-40 J/cm2 | 4600-4800 N |
| reference 1 | 850° C./ 35 MPa | 103-105 HRB | 25-40 J/cm2 | 3400-3600 N |
| reference 2 | 825° C./ 35 MPa | 105-107 HRB | 12-17 J/cm2 | 2900-3100 N |
| reference 3 | 825° C./ 35 MPa | 105-107 HRB | 30-40 J/cm2 | 3600-3800 N |
| reference 4 | 780° C./ 35 MPa | 108-110 HRB | 25-35 J/cm2 | 3800-4000 N |

It can be seen that the samples according to the invention have a hardness which is slightly higher than those of the series of reference samples 1 and 2 produced from other types of polymetal powders. In particular, compared with reference 1, the addition of Mo effectively brings about an increase of the hardness. Compared with the samples based on pure Co, the hardness of the sample according to the invention is comparable with that of the sample based on Co having very fine grains and is higher than that of the sample based on Co having medium-sized grains.

The addition of Mo does not decrease the impact resistance, which remains comparable with that of the samples based on Co having medium-sized grains and can be higher than that of the samples of Co having fine grains.

With regard to the force at break, that of the samples according to the invention further exceeds that of the samples based on Co which were already found to be greater than those of the other references.

The polymetal powders according to the invention can be used in various manners, as can polymetal powders of the prior art. In particular, it is possible to mix them with one or more abrasive additives (carbides, oxides) or with one or more softening additives (Cu, bronze) in order to modulate the properties of the tools. In this manner, the rate of wear is reduced or the cutting speed is increased.

Based on the powder according to the invention which has been described above, diamond-containing saws have been produced, the efficiency levels of which have been compared, during cutting tests of various materials, with those of Co-based industrial saws which, in each case, were considered to be the best available in their category.

On some of these saws, the binding agent was used in the pure state. In others it was used supplemented with micronic tungsten carbide, or with molten carbide (eutectic WC—$W_2C$ molten then crushed into grains of 0.05-1 mm). In most cases, the diamonds were in the non-coated state. In one case, the diamonds were coated with Si in order to prevent their graphitisation, in accordance with a known practice. Other than when a more precise value is given, the concentrations in terms of diamond of the various saws described are conventionally between 0.7 and 1.5 carat/$cm^3$.

Dry Sawing of Asphalt

Saws having a diameter of 300 mm, cutting depth of 5.5 cm, binding agent according to the invention+7% WC; non-coated diamonds.

The wear of the tool is reduced (10.3 $m^2$ cut per mm worn compared with 9.1 $m^2$/mm worn for the saw based on Co), and the cutting speed is increased (620 $cm^2$/min compared with 580 $cm^2$/min for the saw based on Co).

Wet Sawing of Concrete Walls

Saws having a diameter of 700 mm, cutting depth of 25 cm, pure binding agent according to the invention;
machine power 14 kW;
non-coated diamonds.

The wear of the tool is significantly reduced (7.5 $m^2$ cut per mm, compared with 5.1 $m^2$/mm for the saw based on Co) at the expense of an acceptable reduction of the cutting speed (295 $cm^2$/min, compared with 360 cm/min for the Co based saw).

Wet Sawing of Reinforced Concrete Floors

Saws having a diameter of 400 mm, cutting depth of 14 mm, binding agent according to the invention which is pure or reinforced with 6% of molten carbide;
machine power 9.8 kW;
non-coated diamonds, concentration 1.1 carat/$cm^3$, size 50% 30/40 MESH+50% 40-50 MESH.

The wear of the tool is considerably reduced (2.6 or 2.9 $m^2$ cut per mm, compared with 1.9 $m^2$/mm) and the cutting speed increased (600 or 590 $cm^2$/min, compared with 480 $cm^2$/min for the saw based on Co).

Wet Sawing of Reinforced Concrete Blocks

Saws having a diameter of 400 mm, cutting depth of 50 mm, pure binding agent according to the invention;
machine power 23 kW;
non-coated diamonds or diamonds coated with silicon; concentration 1.1 carat/$cm^3$.

The wear of the tool is considerably reduced (11.6 $m^2$ cut per mm compared with 3.3 $m^2$/mm for the Co based saw) at an imposed cutting speed of 500 $cm^2$/min. By using diamonds coated with silicon, the wear can be maintained at 8.5 $m^2$/mm for a mean power of the device in the order of 6 kW identical to that required for the cobalt-based saw. In the two cases, there was no stoppage linked to a peak power greater than 23 kW, whilst the reference binding agent based on Co caused two stoppages: the ease of cutting was therefore increased.

During use, the saws produced with the binding agent according to the invention, in the pure state or supplemented with micronic tungsten carbide or molten carbide, therefore behave at least as well and often clearly better than the best saws based on Co.

Of course, although the production of diamond-containing cutting tools is a preferred application of the polymetal powders according to the invention, it is not exclusive. Other types of sintered components for which similar qualities are required may advantageously be produced using these powders.

The invention claimed is:

1. Polymetal powder, in particular for the production of diamond-containing tools, containing iron, copper, cobalt and molybdenum in contents, in percentages by mass, such that $Fe+Cu+Co+Mo \geqq 98\%$, the balance being oxygen and impurities resulting from the production operation;

$40.5\% \leqq Fe \leqq 46.5\%$ $29\% \leqq Cu \leqq 35\%$ $17\% \leqq Co \leqq 21\%$ $5\% \leqq Mo \leqq 6\%$.

2. Polymetal powder according to claim 1, wherein it has been supplemented with at least one abrasive additive.

3. Polymetal powder according to claim 2, wherein the abrasive additive is selected from oxides and carbides.

4. Polymetal powder according to claim 1, wherein the powder has been supplemented with at least one softening additive.

5. Polymetal powder according to claim 4, wherein the softening additive is selected from copper and bronze.

6. Component which is sintered by means of hot-pressing a polymetal powder, wherein the polymetal powder is a polymetal powder according to claim 1.

7. Sintered component according to claim 6, wherein the polymetal powder has been mixed with a diamond powder.

8. Sintered component according to claim 7, wherein it is a diamond-containing cutting tool.

* * * * *